United States Patent [19]

Roth

[11] Patent Number: 4,681,233

[45] Date of Patent: Jul. 21, 1987

[54] PEGBOARD MOUNTED TOOL HOLDER

[76] Inventor: Howard Roth, 206 Devoe Ave., Yonkers, N.Y. 10705

[21] Appl. No.: 854,300

[22] Filed: Apr. 21, 1986

[51] Int. Cl.[4] ..... A47F 5/08

[52] U.S. Cl. ..... 211/70.6; 211/87; 248/221.2

[58] Field of Search ..... 211/60.1, 70.6, 70.1, 211/87; 248/220.2, 220.3, 220.4, 221.1, 221.2

[56] References Cited

U.S. PATENT DOCUMENTS

| | | | |
|---|---|---|---|
| 1,504,523 | 8/1924 | Sherer | 248/221.2 X |
| 3,112,912 | 12/1963 | Alvarez | 248/221.2 |
| 3,698,563 | 10/1972 | Gordon et al. | 211/70.1 X |
| 3,737,131 | 6/1973 | Larson | 211/70.6 X |
| 4,304,382 | 12/1981 | Jelen | 248/221.1 |
| 4,322,006 | 3/1982 | Marschak | 248/221.1 X |
| 4,343,172 | 8/1982 | Nordlund | 211/70.1 X |
| 4,467,925 | 8/1984 | Ratzloff et al. | 211/70.6 |
| 4,537,821 | 8/1985 | Fast | 248/220.4 X |

*Primary Examiner*—Robert W. Gibson, Jr.
*Attorney, Agent, or Firm*—Amster, Rothstein & Ebenstein

[57] ABSTRACT

A tool holder of unitary construction having a vertical leg and a horizontal leg arranged in an L-shape and made of either metal, plastic or wood and having at least one tab, preferably, two tabs, for securely holding the tool holder to a pegboard or similar mounting surface by means of an interference fit between the tabs and the holes of the pegboard. The tool holder is also provided with a vertical lip extending upward from its horizontal leg and an oblong hole provided through the horizontal leg to allow the holder to hold most common handtools used in carpentry, metal working, cooking and gardening.

18 Claims, 3 Drawing Figures

Fig. 1.
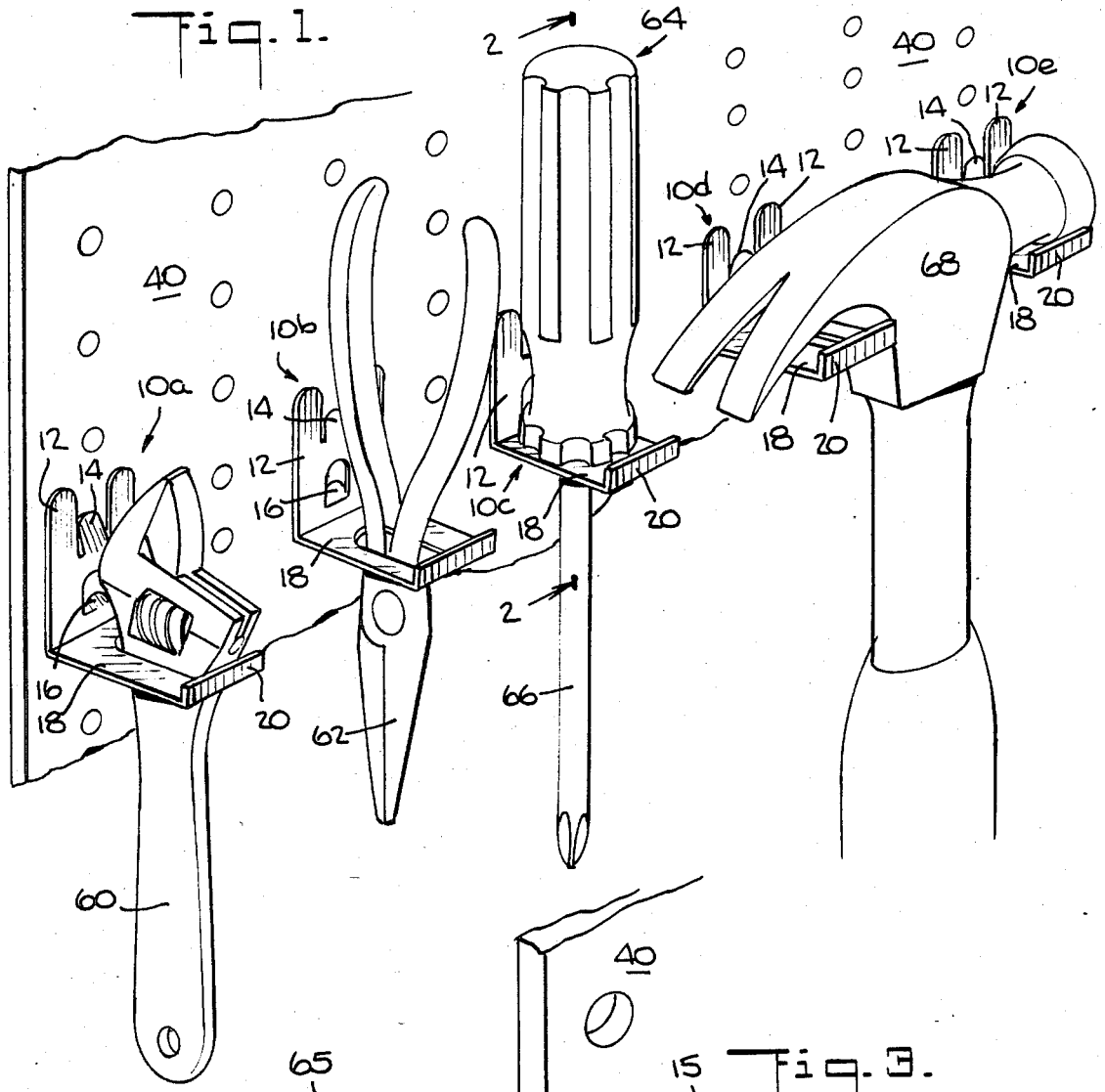
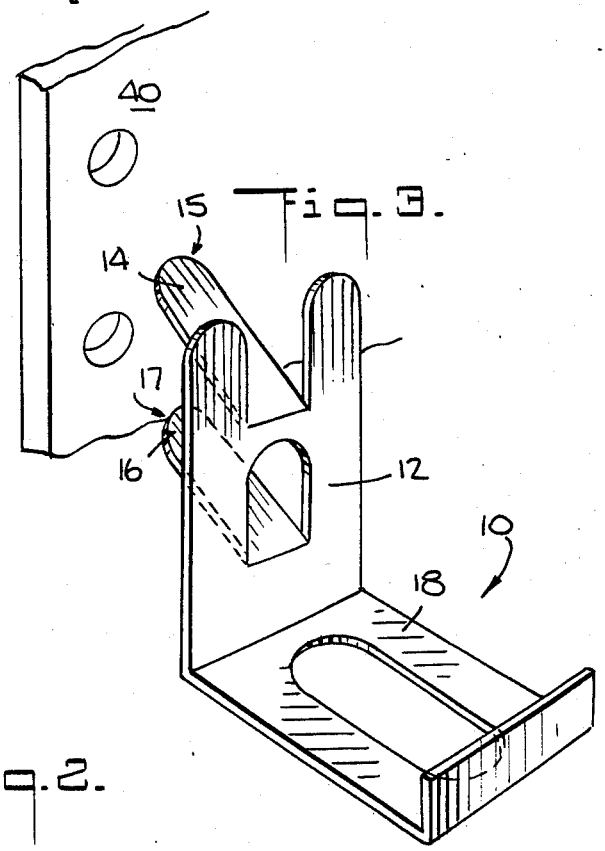
Fig. 3.
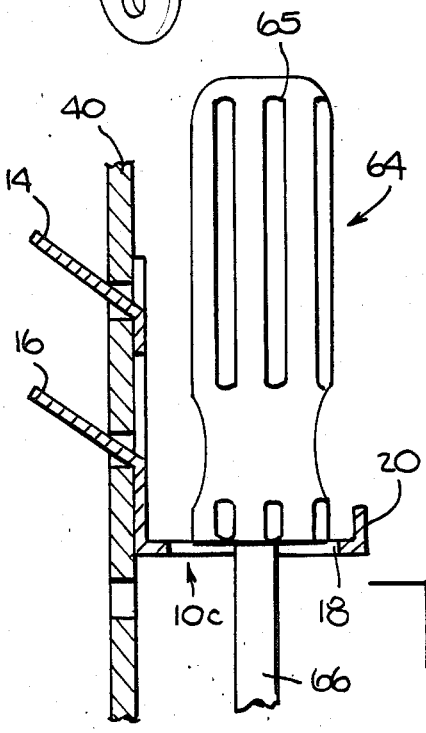
Fig. 2.

PEGBOARD MOUNTED TOOL HOLDER

This invention relates generally to a tool holder and more particularly, to an improved tool holder that is of simple and economical construction which is capable of supporting most types of hand tools used in carpentry, metal work, and the like, on a pegboard.

Tool holders of this type generally employ hooks or loops mounted to a pegboard or other surface to hold such tools for storage. One such device well known in the art is made of heavy wire formed into an L-shaped segment of differing sizes at the top and bottom of the device. The smaller L-shaped segment is at the top and provides the means of engagement to the pegboard by having the horizontal projection of this smaller segment traverse the material thickness of the board while the vertical projection is upright on the back side of the board opposite that upon which tools are hung. The larger segment extends downwardly from the small segment and the horizontal portion of the larger segment projects away from the board providing a projection upon which the tools are hung. The horizontal projection must engage a hole on the tool. Another drawback of this type of tool holder device is the fact that many tools do not possess the necessary holes or openings for engagement with the tool holder and to hold such tools securely to the device. Other disadvantages are the tendancy of such holders to rotate, or otherwise be unstable due to their construction from round wire and placement in the round holes of the pegboard. In addition, holders of such construction frequently fall from common pegboards. While wire spring clips or lugs have been added to these devices to control rotation and more securely affix such holders to the pegboard, these features have detracted from the holder's economy and convenience while not expanding the applicability of these holders to a broader range of tools.

The prior art also includes many special purpose tool holders made for pegboard use wherein wire has been bent to define circular holes or loops in a horizontal plane. While these kinds of holders are useful for storing long thin tools, e.g. screwdrivers, having a handle larger than the diameter of the loop created, they generally involve a more costly construction and are able to hold only certain kinds of tools.

It is therefore an object of the present invention to provide an improved pegboard mounted universal tool holder which overcomes these and other shortcomings of the prior art and, specifically, to provide a commercial tool holder which may be used to hold almost all of the common hand tools used in carpentry, metal working, cooking and gardening.

It is also an object of the invention to provide a durable tool holder that is of simple and economical construction.

Accordingly, the foregoing and related objects are achieved by the present invention which overcomes the disadvantages of the prior art by providing a tool holder of unitary construction made of either flat metal, plastic or wood and having, preferably, two tabs for securely holding it to a pegboard. The tool holder is L-shaped and is provided with a vertical lip extending upward from its horizontal leg with an oblong hole provided through such leg to allow the holder to hold most common hand tools. Preferably, the tabs extending from the vertical leg of the holder are provided with other than a rounded shape so that an interference fit may be created with the holes of the pegboard in order to securely hold the inventive tool holder in place.

Other objects and features of the present invention will become apparent from the following detailed description when taken in connection with the accompanying drawings, which shows a preferred, albeit illustrative embodiment of the invention.

It is to be understood that the drawings are designed for the purpose of illustration only and are not intended to define the limits of the invention.

In the drawings, wherein similar reference numerals denote similar elements throughout the several views:

FIG. 1 is a perspective view of several universal tool holders of the present invention secured to a pegboard holding various tools;

FIG. 2 is a side elevational view, in section, taken along line 2—2 of FIG. 1 looking in the direction of the arrows, showing the tool holder with a screwdriver engaged therein; and FIG. 3 is a perspective view of the tool holder of the present invention prior to its placement in a pegboard.

Referring now to the drawings and in particular to FIG. 1 which shows several variations of the tool holder of the present invention generally designated by the reference numeral 10, specifically, FIG. 1 is a perspective view of five tool holders 10*a*, 10*b*, 10*c*, 10*d*, 10*e* of the present invention subsequent to their secure engagement to a pegboard 40. The tool holders, which are preferably made of metal, e.g., hardened aluminum, are shown holding some of the more common tools employed in carpentry. Specifically, tool holder 10*a* is shown holding a wrench 60; tool holder 10*b* is shown holding a pair of pliers 62; tool holder 10*c* is shown holding a screwdriver 64; and tool holders 10*d* and 10*e*, in combination with one another, are shown holding a hammer 68.

Tool holder 10 is substantially L-shaped having a vertical leg 12 and a horizontal leg 18. Vertical leg 12, preferably, includes an upper tab 14 and a lower tab 16 for securing tool holder 10 to a supporting pegboard by placement of tabs 14 and 16 through two vertically aligned holes of pegboard 40. Horizontal leg 18, which extends substantially perpendicularly from the lower horizontal edge of vertical leg 12, is provided with an oblong hole for holding such tools as wrenches, pliers and screwdrivers in the manner shown by tool holders 10*a*, 10*b* and 10*c*, respectively.

Horizontal leg 18 is further provided with a vertical lip 20 which extends upward from the edge of horizontal leg 18 and which is substantially parallel to vertical leg 12. Vertical lip 20 is useful for retaining such tools as a hammer 68, in the manner shown, across the horizontal legs 18 of tool holders 10*d* and 10*e*. It should be understood that the tools shown in FIG. 1 are merely representative of the wide variety of tools which may be held by the inventive tool holder.

FIG. 2 is an side elevational view in section of tool holder 10 secured to pegboard 40 and retaining screwdriver 64. Tool holder 10 is secured to pegboard 40 by an interference fit between the upper tab 14 and lower tab 16 and two vertically aligned holes of pegboard 40. This figure further illustrates that screwdriver 64 is retained by permitting screwdriver handle 65 to rest upon horizontal leg 18 with the shaft portion 66 of screwdriver 64 passing through the oblong hole of horizontal leg 18.

Finally, FIG. 3 illustrates a perspective view of the tool holder 10 prior to its engagement with pegboard 40. Tool holder 10 is secured to pegboard 40 by lower tab 16 and upper tab 14, which extend inwardly and upwardly from vertical leg 12. The tabs 14, 16 are inclined in an alignment preferably substantially parallel to each other at a distance from each other corresponding substantially to the vertical distance between adjacent holes in pegboard 40. The tabs 14, 16 preferably, have a planar construction with rounded ends 15, 17 for easy insertion through two vertically aligned holes of pegboard 40. The width of tabs 14 and 16 is sufficient to create an interference fit with the holes of pegboard 40, i.e., the width of tabs 14, 16 should be substantially equal to the diameter of the holes of the pegboard to which tool holder 10 is to be secured.

In a preferred embodiment of the present invention, wherein pegboard 40 has a thickness of ¼" and is employed as the surface upon which the tool holder 10 is affixed, it is preferred that tool holder 10 be made of a flat material, preferably, hardened aluminum, that is 0.060–0.070 inches thick. It is also preferred that the width of tool holder 10 be 0.750–0.875 inches with horizontal leg 18 being approximately 1.375 inches in length and vertical leg 12 being about 1.75 inches in length. The oblong hole at the center of horizontal leg 18, preferably, has dimensions of approximately 1.125 inches in length and 0.50 inches in width. Vertical lip 20 of horizontal leg 18 is, preferably, about 0.25 inches high. Tabs 14, 16 along the side of vertical leg 12 contacting pegboard 40 should, preferably, be parallel to one another and approximately 1.0 inch apart with the upper edge of vertical leg 12 extending approximately 0.25 inches beyond the top of upper tab 14. When tabs 14, 16 engage pegboard 40, for a secure fit, it is preferred that each tab be bent at an angle to vertical leg 12 of between 54°–60°, with an angle of 56° being most preferred. Finally, it is preferable if tabs 14, 16 are each 0.75 inches in length and 0.25 inches in width with a thickness, preferably, of between 0.060–0.070 inches; a thickness of 0.062 inches is most preferred.

The tool holder of the present invention is particularly adapted to be constructed from a single piece of flat metal and formed in a simple, continuous fabricating process involving punching and bending or molded from a single piece of plastic.

It should also be apparent that other variations may be made as will be apparent to those skilled in the art. For example, the dimensions of the tool holder may be varied to satisfy the particular needs of the user or the width of the tool holder may be increased to a sufficient amount to incorporate two or more upper tabs and two or more lower tabs to engage more than two holes in the pegboard to accommodate larger and/or heavier tools.

Thus, while only a preferred embodiment of the present invention has been shown and described, it will be obvious that many changes and modifications may be made thereunto, without departing from the spirit and scope of the invention. Consequently, the appended claims should be broadly construed.

What is claimed is:

1. A holder of unitary construction for holding tools on a pegboard mounting surface, comprising:

a vertical leg having two tabs extending upwardly away from said vertical leg of said holder and substantially parallel to one another to engage and secure said holder to a mounting surface behind said holder by means of an interference fit;

a horizontal leg, extending substantially perpendicular outwardly from said vertical leg, having a hole therein; and a lip extending upward from said horizontal leg.

2. A holder of unitary construction for holding tools on a pegboard mounting surface, comprising:

a vertical leg having two tabs angled upwardly away from said vertical leg of said holder at an angle of 54°–60° from said vertical leg to engage and secure said holder to a mounting surface behind said holder by means of an interference fit;

a horizontal leg, extending substantially perpendicular outwardly from said vertical leg, having a hole therein; and a lip extending upward from said horizontal leg.

3. The holder according to claim 1, wherein said tabs have a flat construction and engage and secure said holder to said surface.

4. The holder according to claim 3, wherein said tabs are each approximately 0.75 inches in length, approximately 0.25 inches in width and have a thickness of approximately 0.06–0.07 inches.

5. The holder according to claim 2, wherein said vertical leg is approximately 1.75 inches in length and approximately 0.750–0.875 inches in width.

6. The holder according to claim 1, wherein said horizontal leg has a substantially flat rectangular construction.

7. The holding according to claim 1, wherein said hole is oblong and is approximately 1.125 inches in length and approximately 0.5 inches in width.

8. The holder according to claim 1, wherein said holder is made of metal.

9. The holder according to claim 8, wherein said holder is made of hardened aluminum.

10. The holder according to claim 1, wherein said holder is made of plastic.

11. The holder according to claim 1, wherein said holder is made of wood.

12. A holder of unitary construction for holding tools on a pegboard mounting surface, comprising:

a vertical leg having a planar construction and two tabs angled upwardly away from the vertical leg in substantially parallel vertical alignment to engage and secure said holder to a mounting surface by means of an interference fit created between said vertically aligned tabs and two vertically aligned holes through said mounting surface;

a substantially planar horizontal leg extending substantially perpendicularly from said vertical leg at a bottom surface of said vertical leg and having an oblong hole therethrough; and a lip extending upwardly from said horizontal leg at an edge of said horizontal leg remote from said mounting surface substantially parallel to said vertical leg.

13. The holder according to claim 12, wherein said tabs have a flat construction.

14. The holder according to claim 13, wherein said tabs are each approximately 0.75 inches in length, approximately 0.25 inches in width and have a thickness of approximately 0.06–0.07 inches.

15. The holder according to claim 12, wherein said tabs are bent upward at an angle of 54°–60° from said vertical leg.

16. The holder according to claim 12, wherein said holder is made of metal.

17. The holder according to claim 16, wherein said holder is made of hardened aluminum.

18. The holder according to claim 12, wherein said oblong hole is approximately 1.125 inches in length and approximately 0.5 inches in width.

* * * * *